United States Patent [19]

van der Gaarden

[11] 4,439,064

[45] Mar. 27, 1984

[54] TUNNEL FRAMINGS

[75] Inventor: Cornelis van der Gaarden, Ysselstein, Netherlands

[73] Assignee: Outinord St. Amand S.A., Saint Amand les Eaux, France

[21] Appl. No.: 374,898

[22] Filed: May 4, 1982

[30] Foreign Application Priority Data

Apr. 28, 1981 [FR] France ..... 81 08825

[51] Int. Cl.³ ..... E21D 11/10

[52] U.S. Cl. ..... 405/150; 249/11; 405/146

[58] Field of Search ..... 405/146, 148, 150, 151, 405/153, 288, 290; 249/10, 11

[56] References Cited

U.S. PATENT DOCUMENTS

| | | | |
|---|---|---|---|
| 3,678,693 | 7/1972 | Markewitz et al. | 405/290 |
| 3,693,927 | 9/1972 | Jennings | 249/11 |
| 3,979,919 | 9/1976 | Blonde et al. | 405/146 |
| 4,261,542 | 4/1981 | Lefebvre | 405/150 X |

FOREIGN PATENT DOCUMENTS

| | | | |
|---|---|---|---|
| 2118004 | 12/1971 | Fed. Rep. of Germany | 249/11 |
| 8000601 | 9/1981 | Netherlands | 249/11 |
| 8002999 | 12/1981 | Netherlands | 249/11 |

*Primary Examiner*—David H. Corbin

*Attorney, Agent, or Firm*—Harding, Earley, Follmer & Frailey

[57] ABSTRACT

The present invention relates to improvements in U-shaped tunnel framings for poured concrete constituted of two half shells or half casings in the form of a right-angled dihedron. The framings are characterized by the combination in each half casing of a horizontal beam composed of two telescopic sections, a set of panels of modular width resting on the two sections of the horizontal beam and being juxtaposed exactly with respect to it and a horizontal reinforcing beam for stiffening and supporting the bottom of the half casing and located inwardly of its vertical panel. The invention is applicable to the simultaneous construction of walls and ceilings of poured concrete.

8 Claims, 15 Drawing Figures

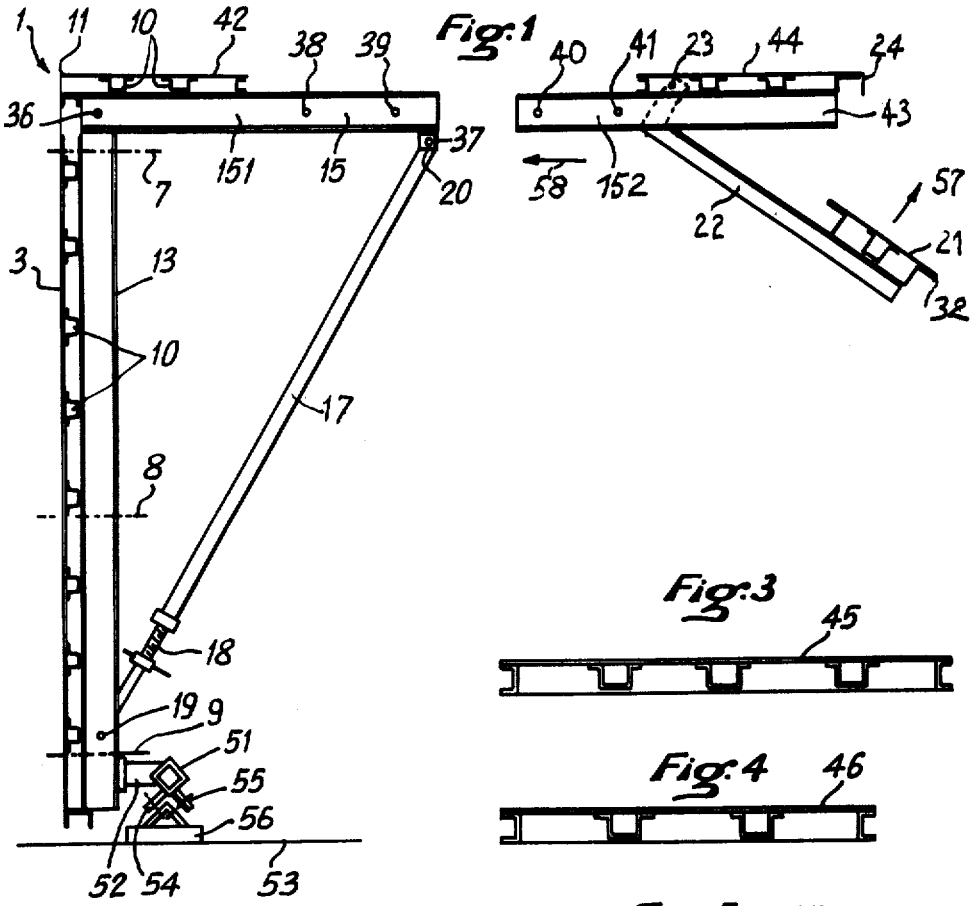
Fig:1
1
11
10
42
38
39
36
37
151
15
20
7
3
13
10
17
8
18
19
9
51
55
56
52
54
53
40
41
23
44
24
43
58
152
22
57
21
32
Fig:3
45
Fig:4
46
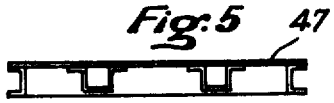
Fig:5
47
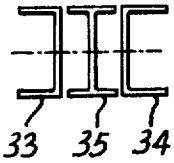
Fig:2
33
35
34
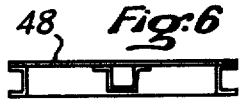
48
Fig:6
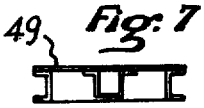
49
Fig:7
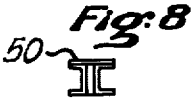
Fig:8
50

TUNNEL FRAMINGS

TECHNICAL FIELD

The present invention deals with improvements to tunnel-framings for poured concrete of the type having two half shells or half-casings each consisting of a vertical panel supported on the ground by means of adjustable screw-jacks and a horizontal half-panel composed of several rectangular panel elements having elongated sides parallel to the edge of the dihedron; the vertical panel and the horizontal half-panel being connected by struts of adjustable lengths, each panel consisting of a framing surface supported by omega-shaped braces which are themselves sustained by vertical and horizontal beams perpendicular to the edge of the dihedron at the height of the struts and hinged to each other at the level of the edge.

PROBLEM TO BE SOLVED

The height between the floor and ceiling varies little from one construction to another. However, the sizes of the rooms, that is the distances between the walls, vary greatly. Tunnel-framings, well known for 25 years, must be able to adapt the size of their horizontal panel to the surface of the ceilings. The present invention proposes a solution to this problem of dimension adaptation.

PREVIOUS STATE OF THE ART AND ITS DRAWBACKS

It is known that tunnel-framing, with which it is possible to construct simultaneously from concrete two lateral walls and a celing, are classified into two large groups;

The first group includes the two-half-casing type framing which has been described principally in French Pat. No. 1,180,699, of June 17, 1957, and its addition No. 73,650, of May 29, 1958. Some improvements have been described in French Pat. No. 2,136,400, of Apr. 11, 1972, and in French Pat. No. 2,256,671, of Dec. 28, 1973, to which can be added its first certificate of addition No. 2,323,844, of Dec. 3, 1974; these last two patents provide improvements which will make it possible to accelerate the utilization of the framing.

The connection between the free edges of the half-casing horizontal panels is made by means of key bolts which have been described in French Pat. No. 2,136,400, of Apr. 11, 1972.

The second group is the one known as "RETRACTABLE FRAMING", that is those in which the horizontal panel is assembled in one piece that can be shaped by curving it downward in order to bring closer together the two edges of the dihedrons created by the horizontal panel and the vertical panels or sides. These framings were described in the French Pat. No. 1,512,440, of Dec. 23, 1966, and its certificate of addition No. 95,181, of June 17, 1968, as well as in French Pat. No. 1,600,108, of Dec. 30, 1968, and its certificate of addition No. 2,079,546, of Feb. 4, 1970. An improvement to this type of framing has been disclosed in French patent application No. 78/22894, filed July 25, 1978.

In all the existing applications described in the patents referred to above, there is a significant difficulty in the adaptation of the length of the horizontal panel to that of the ceiling. Generally, it is necessary to change the whole horizontal panel, which is made of two pieces in the half-casing framings and of one piece in the retractible framings. In these latter framings, panels with several rectangular sections placed side by side have been built; however the dimensions of these sections must be modified according to the sizes of the ceilings to be poured.

For the half-casing framings, these drawbacks have been partially corrected by supplying additional pivotal panels fitted at the end of each horizontal panel, opposite from the edge of the dihedron. But such adaptation in width is made with a short range of dimensions, since every time it is necessary to change the additional panel. The goal of the present invention is to avoid the above drawbacks and to provide the possibility of increasing the range of widths of the horizontal panels in order to adapt them to practically all ceiling dimensions. This is obtained by a system of modular panels.

SUMMARY OF THE INVENTION

The framings according to the invention are characterzied by the combination, on each half-casing, (a) of horizontal beams having two telescopic sections one section, the closest one to the edge, supports a horizontal panel element that includes the edge of the dihedron, and is less wide than the length of the said beam section; the extremities of said beam section being supported, on one side, by an articulation on a vertical beam, and on the other side, by the strut.

the other beam section is attached to the first section and supports, at its free extremity, another horizontal panel element, said end panel being less wide than the length of the said second section, thus allowing a gap between each of the panels supported by the two telescopic sections; the width of that gap is determined selectively based on the length of the sections, the width of the panels and the connecting device used between the sections;

(b) a set of panels of modular widths designed to fill said gap, and supported on the two horizontal beam sections and being placed exactly side by side, (c) a horizontal reinforcing beam, to stiffen and support the bottom inwardly of the vertical panel.

In the case of two-half-casing tunnel-framings, each half-casing may have an additional segment, that is to say a supplementary panel placed beyond the end-panel, which supplementary panel is supported by oscillatable levers at the end of the second horizontal beam section. These levers can be fastened as an extension of said second beam section in order to support the additional panel segment in the plane of the horizontal panel when this is necessary. Whether the additional band is used or not, bolts are provided to join together the free edges of the horizontal panels of the two half-casings. The bolts are of a known type that is described, particularly, in French Pat. No. 2,136,400, of Apr. 11, 1972. In the case of retractible tunnel-framings, the free edges of the two-half-casing horizontal panels are joined by an articulation that permits deflection of the horizontal beams at their junction, and of the horizontal panel at that level.

In both framings, the horizontal reinforcing beam at the base of the vertical panels is used as a sliding track for fixed bearing supports mounted on the floor, to facilitate longitudinal movement of the half-casings.

According to a preferred application, the horizontal beam at the base of each vertical panel has a square section with a vertical diagonal, and the two lower sides of the beam are supported on runners the axes of which have an inclination of 45°, and are attached to supports that rest on the floor.

In both types of framing the horizontal beam section closest to the edge is composed of two back-to-back U irons with vertical webs set at a distance from each other sufficient to permit the sliding insertion of another section which constitutes the other horizontal beam section.

SOLVING THE PROBLEM, ADVANTAGES AND INDUSTRIAL RESULTS

The improvements provided by the invention make it possible to adjust exactly the dimensions of the horizontal panel of the casing due to the utilization of properly chosen modular panels. In particular, there is provided a small panel equal to the difference in thickness of wall thickness, and thin shims allowing the adaptation of one and the same casing to distances between axes of identical walls.

In other respects, additional oscillating segments are eliminated to the maximum, to the extent that the joints between panels are adjusted with precision, and open joints are avoided. Thus, there are no concrete seams to be retouched.

It is also understood that the investment in framings is reduced since the same equipment can be used for ceilings of various dimensions and can be paid for in a shorter time.

The invention will be better understood with the aid of the following description which provides non-limiting examples of its practical application, more specifically in relation to the two-half-casing type of framing. Attached drawings illustrate this example.

BRIEF DESCRIPTION OF THE DRAWINGS

FIG. 1 is a fragmentary vertical section, perpendicular to the edge of the dihedron, of a half-casing with a horizontal panel in two parts, the panel furtherest from the edge being separated from the other one, for clarity of illustration, and containing an additional segment articulated at the end of an oscillatable lever.

FIG. 2 is a transverse vertical section of the horizontal beam that supports the horizontal panel taken at the junction of the two telescopic sections.

FIGS. 3 to 7 illustrate a series of panels of modular widths designed to fill the gap between the two horizontal panel elements, that is the panel closest to the intersection and the end-panel.

FIG. 8 is a vertical section similar to figures 3 to 7, of a very narrow intermediate panel or segment, the width of which is less than the thickness of the walls.

DESCRIPTION OF SOME PREFERRED EMBODIMENTS

Figure 9:
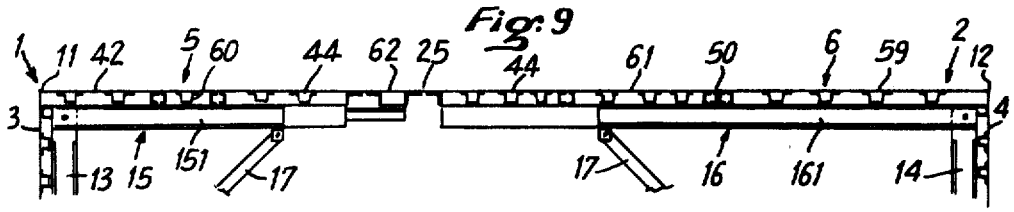
FIGS. 9 to 15 are fragmentary vertical sections perpendicular to the edges of the upper part of various tunnel-framings having horizontal panels of the same breadth, such panels being constructed of different variants, with panel elements of different widths, showing therefore the great possibilities provided by the framing of the invention.
Figure 10:
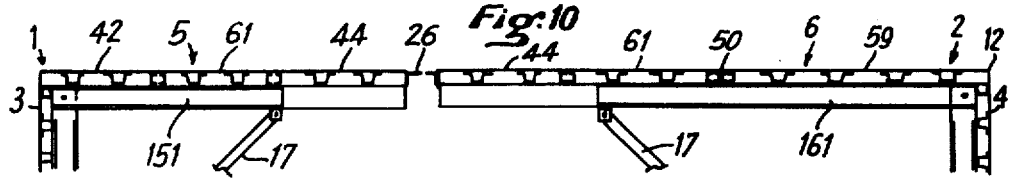

According to a first version, the tunnel-framing comprises to half-casing such as (1) and (2). Each half-casing (1) or (2) includes a vertical panel (3) or (4) and a horizontal panel (5) or (6). The vertical panels (3) and (4) are supported on the ground by means of jacks (not shown) which permit slight vertical displacement of the height of a framing, as explained in the above mentioned patents. The vertical panels of two contiguous tunnel-framings or of a tunnel-framing with a panel segment are connected by struts or rods shown as broken lines (7), (8), (9). The vertical panels (3), (4) like the horizontal panels (5), (6), include enclosing surfaces supported by omega-shaped braces (10) preferably positioned parallel to the outer edges (11), (12) of the dihedrons, and which are themselves supported by vertical beams (13), (14) and horizontal beams (15), (16) arranged in planes perpendicular to the edges (11), (12). The base of the vertical beams (13), (14) is connected to the middle part of the horizontal beams (15), (16) by struts such as (17) whose length can be adjusted by a screwing device (18); the struts (17) are articulated at (19) at the base of the vertical beams and at (20) at the horizontal beams.

It is common to provide a horizontal panel such as (5), (6), with an additional panel segment (21) capable of being placed at the end of the panel through the simple oscillation of oscillatable levers such as (22) articulated at (23) in order to change the width of the horizontal panel. In fact, one can provide a selected series of additional segments (21) in order to have available a corresponding series of widths for the horizontal panels (5) or (6). However these series are often found to be insufficient, and this is precisely one of the problems that the present invention intends to eliminate.

The free edges of the horizontal panels of two half-casings, such as (1) or (2), are generally connected by key bolts similar to those which were described in French Pat. No. 2,136,400, of Apr. 11, 1972. These bolts then are placed at the locations marked (24) (FIG. 1) or (25 to 31) (respectively in FIGS. 9 to 15). In the case where an additional segment (21) is used (FIG. 1), the key bolt is located on the edge (32) (FIG. 1).

The foregoing is not part of the invention now about to be described, but is instead comprised in the state of the art.

According to the invention, the horizontal beam (15) is divided into two telescopic sections (151), (152) abutting each other lengthwise (FIG. 1).

Section (151), the one closest to the outer edge (11) or (12), is made of two U irons (33), (34) (FIG. 2) whose vertical webs are back to back. The two U irons (33), (34) have enough separation between them to allow the sliding therebetween of a shaped section (35) which constitutes the second section (152) of the horizontal beam (15). The first section (151) is articulated at its distal end at (36) at the top of the vertical beam (13). At its other end, it has a bearing (37) comprising the articulation for the strut (17).

The sections (151) and (152) are attached to each other by bolts passing through the holes (38) to (41). Those holes are perforated in locations determined by the width desired for the horizontal panels (5), (6) as will be described below.

Section (151) supports, in a fixed manner, a horizontal panel element (42), including the edge (11), which is much less wide than the length of section (151). The second section (152) supports, adjacent its proximal end (43), another horizontal panel element (44), said end panel (44) also being much less wide than the length of the said second section (152).

Normally, when the two sections (151) and (152) are attached together by means of bolts passing through the holes (38), (39), (40) and (41), there is a gap between the panel elements (42) and (44), the side of which gap is determined selectively according to the length of the sections (151) and (152) (several kinds of sections 151 and 152 are provided for a same tunnel-framing), the width of panel elements (42) and (44) and the location chosen for the holes (38) to (41) in order to make the connection between sections (151) and (152).

Moreover, in an extreme case, that gap can be reduced to nought when the I beam (35) is completely inserted between the two U irons (33) and (34), so as to insure a gapless joint between the elements (42) and (44). But generally, it is filled by modular length panels (45) to (50) (FIGS. 3 to 8) used by themselves or in various combinations, as will be explained below.

In the half-casings of the conventional tunnel-framings, the horizontal panels such as (5) and (6) are made in one piece and contribute to the strength of the whole structural device which can be handled, for example, by construction cranes, without losing their shape. Now, in the present case, each half-casing contains, as its horizontal panel, only element (42) which is structurally too weak to insure sufficient rigidity of the half-casing which, under common handling conditions, will lose its shape by becoming rounded at the base of the vertical panels (3) or (4). For that reason, within the scope of the present invention, it has been necessary to adapt to the above described device a horizontal reinforcing beam (51) attached to the base of the vertical panels (3) and (4) by supports (52). Of course, the beam (51) is placed inwardly of the vertical panel (3) or (4). To take advantage of the presence of that horizontal reinforcement beam (51), it is given the role of a sliding track for the fixed bearing supports which lie on the floor (53) and which facilitate the longitudinal displacement of each half-casing (1) or (2). To accomplish this role, it is advantageous for the beam (51) to have a square cross-section with a vertical diagonal so that the two lower sides of the beam (51) are supported on diverging runners (54), (55), the axes of which are inclined at 45° in relation to the horizontal, and which are fastened on supports (56) which rest on the floor (53).

In the arrangement of FIG. 1, the use of the additional segment (21) is optional. If it is not used, the key bolts are fastened on the proximal end (43) and the additional segment (21) hangs under the section (152), unused. If it is desirable to increase the dimension of the horizontal panel (5), the oscillatable lever (22) is raised by pivoting it about the articulation (23), in the direction of the arrow (57), and the said lever (22) is fastened in prolongation of the section (152), by means of bolts, for example. The key bolt is then placed at (32) in the free end of the additional segment (21).

In all cases, before using the half-casing (1) and (2), the horizontal panel (5) or (6) is completed by laying the end-panel (44) against the horizontal panel element (42), by moving the section (152) in the direction of the arrow (58), and by bolting the said section (152) to section (151) (that is to say the I beam (35) to the U irons (33) and (34)—FIG. 2); of course, the length of the horizontal panel (5) and (6) can be adusted by putting between the end panel (44) and the horizontal panel element (42) one of the panel elements (45) to (50), or a combination thereof; also, one may or may not use the additional segment (21).

At the key locations (24) to (32), it is possible to use standard rigid or articulated key-bolts, when using a tunnel-framing with two rigid half-casings belonging to the first group described at the beginning of the present specification.

It is also possible to use key-bolts that permit mutual bending of the two horizontal half-panels (5) and (6), in the case of the second group of tunnel-framing, that is to say "retractable framings".

Examples of various combinations have been illustrated in FIGS. 9 to 15 which now will be briefly described.

The horizontal half-panels (5) and (6) of the arrangements illustrated in FIGS. 9 to 15 comprise:

additional panel segments (21)
small stationary horizontal panel elements (42)
end panels (44)
small horizontal panel elements (50) of a width less than the thickness of a wall
large stationary horizontal panel elements (59)
small intermediary panels (60)
medium intermediary panels (61)
small end panels (62)
small additional segments (63)
small horizonttal beam sections (151)
and large horizontal beam sections (161).

Of course, one can utilize other elements, principally those of FIGS. 3 to 7, interposed in the construction of the horizontal panels.

In the case of FIG. 9, panel elements (42), (60), (44), (62), (44), (61), (50) and (59) are used from left to right and in sequence.

In FIG. 19, proceeding from left to right, in sequence, elements (42), (61), (44), (61), (50) and (59) are used.

Figure 11:
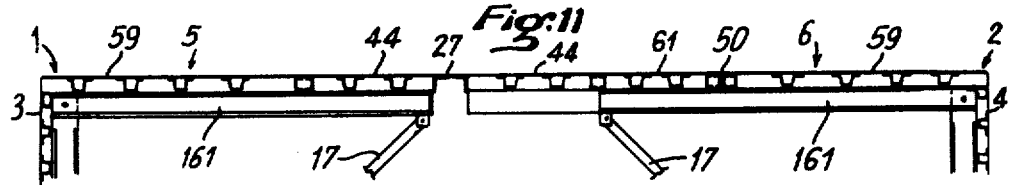

In FIG. 11, elements (59), (44), (44), (61), (50) and (59).

Figure 12:
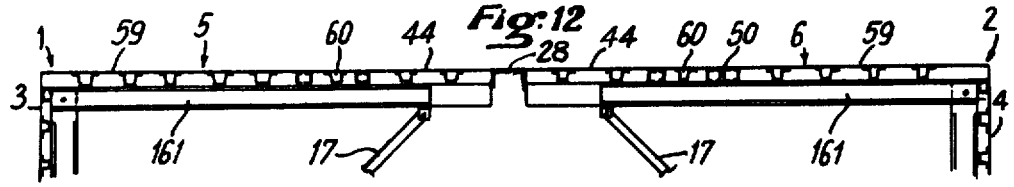

In FIG. 12, elements (59), (60), (44), (44), (60), (50) and (59).

Figure 13:
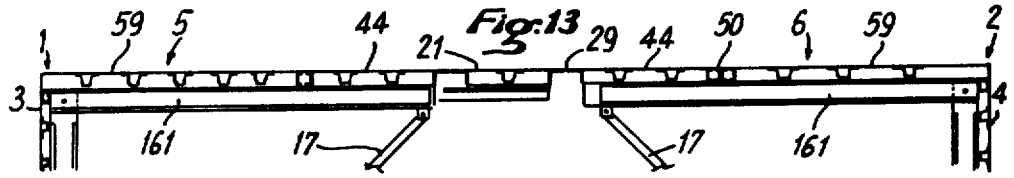

In FIG. 13, elements (59), (44), (21), (44), (50) and (59).

Figure 14:
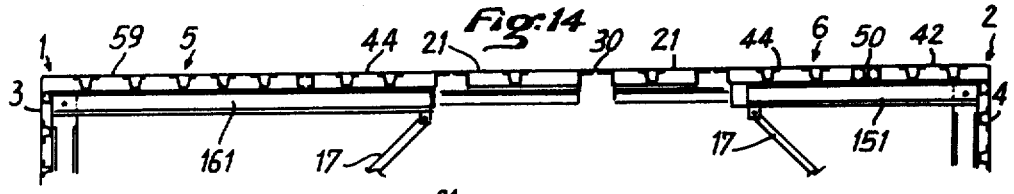

In FIG. 14, elements (59), (44), (21), (21), (44), (50) and (42).

Figure 15:
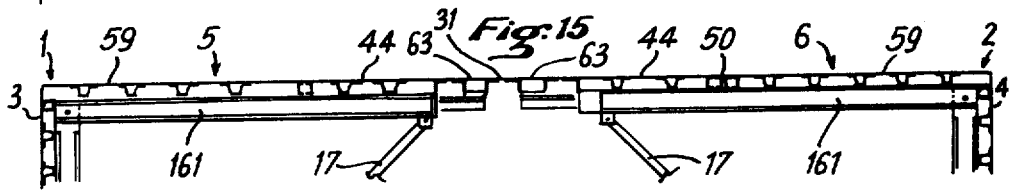

In FIG. 15, elements (59), (44), (63), (63), (44), (50) and (59).

What precedes is only a simple example showing that for the same ceiling dimension, it is possible to use at least seven different combinations. It is evident that it is impossible to illustrate or describe all the imaginable combinations. But one will readily understand that the modular combinations that can be obtained with the assemblages of horizontal panel elements of the present invention permit its adaptation to practically all dimensions of ceilings.

Particular mention must be made in reference to the small panel element (50) which permits modification of the over-all length of the panel on account of thickness of the same wall. Supposing that in the lower part of a construction one must use walls of 22, while for the upper part walls of 11 are sufficient because the weight to be supported is less, it is clear that the rooms of the upper floors may be slightly larger than those of the lower floors. To change from one dimension to the other, it will suffice to add a small panel element (50) without having to use any other type of framing.

Finally, it is to be observed that all the horizontal panel elements normally are firmly fitted against each other, thereby avoiding open joints and concrete seams which require trimming.

I claim:

1. A half casing for tunnel framings for poured concrete, said half casing having a vertical panel supported by vertical beams, said vertical beams having upper and lower ends, a horizontal panel constituted of plural panel elements supported by horizontal beams, said horizontal beams having distal ends connected pivotally to the upper ends of the vertical beams, said vertical and horizontal panels forming a right-angled dihedron having an outer edge, and adjustable struts connecting the proximal ends of the horizontal beams to the lower ends of the vertical beams, characterized in that each half casing comprises (a) horizontal beams composed of inner and outer telescopic beam sections, said inner beam sections being connected pivotally to the upper ends of the vertical beams and said outer beam sections including the proximal ends of the horizontal beams, (b) a horizontal panel element supported on the inner telescopic beam sections, said horizontal panel element including the edge of the dihedron and having a width shorter than the length of said inner beam sections, (c) a second horizontal panel element supported on the outer telescopic beam sections adjacent their proximal ends, said second panel element having a width shorter than the length of said outer beam sections, whereby a horizontal gap is provided between said two horizontal panel elements, (d) connection means for connecting the inner and outer telescopic beam sections together at selected telescopic positions relative to each other, thereby to vary selectively the width of the gap between the two horizontal panel elements, (e) a plurality of horizontal panel elements of modular widths for selected insertion into the gap to completely close the gap and (f) a horizontal reinforcing beam affixed to the lower ends of the vertical beams for stiffening and supporting the vertical panel.

2. The half casing of claim 1, further including (a) an additional panel segment constituting an extension of the horizontal panel, (b) oscillatable levers supporting the additional panel segment and (c) means connecting the oscillatable levers pivotally to the outer telescopic beam sections, whereby the additional panel segment may be advanced to the horizontal panel for connection therewith, or may be retracted from the horizontal panel.

3. The half casing of claim 1, further including panel connection means remote from the edge of the dihedron for connecting the horizontal panel of the half casing to the horizontal panel of a complementary half casing.

4. The half casing of claim 3, wherein the panel connection means connecting the two horizontal panels is articulated, whereby the horizontal panels are deflectable at the location of said connection means.

5. The half casing of claim 1, further including (a) a bearing support for the half casing and (b) a pair of longitudinal runners mounted on the bearing support, (c) said runners supporting the horizontal reinforcing beam slidably to facilitate longitudinal displacement of the half casing.

6. The half casing of claim 1, wherein (a) the horizontal reinforcing beam is square in cross-section and has a vertical diagonal and (b) a pair of diverging longitudinal runners support the horizontal reinforcing beam slidably, said runners being disposed at 45° to the horizontal, (c) said runners being engageable slidably with the lower surfaces of said reinforcing beam to facilitate longitudinal displacement of the half casing.

7. The half casing of claim 1, wherein (a) each inner telescopic beam section is composed of a pair of parallel sections having vertical webs disposed in uniformly spaced relation to each other and (b) each outer telescopic beam section comprises a single section disposed slidably between the spaced webs of one of said pairs of sections in parallel relation thereto.

8. The half casing of claim 7, wherein (a) the sections comprising the inner telescopic beam sections are U irons and (b) the sections comprising the outer telescopic beam sections are I beams.

* * * * *